US006935405B2

(12) United States Patent
Chen et al.

(10) Patent No.: US 6,935,405 B2
(45) Date of Patent: Aug. 30, 2005

(54) SINK COMPOUND LAMINATE MODELING PROCESS

(75) Inventors: Yung-chen Chen, Taoyuan (TW); Chuan-Cheng Huang, Taoyuan (TW); Jia-Jen Yeh, Taoyuan (TW)

(73) Assignee: Loyalty Founder Enterprise Co., Ltd., Taoyuan (TW)

( * ) Notice: Subject to any disclaimer, the term of this patent is extended or adjusted under 35 U.S.C. 154(b) by 0 days.

(21) Appl. No.: 10/674,351

(22) Filed: Oct. 1, 2003

(65) Prior Publication Data

US 2005/0072546 A1 Apr. 7, 2005

(51) Int. Cl.[7] ..... B22D 19/00; B22D 27/09; B22D 27/15

(52) U.S. Cl. ..... 164/98; 164/103; 164/65; 164/66.1

(58) Field of Search ..... 164/98, 100, 103, 164/105, 112, 61, 65, 66.1

(56) References Cited

U.S. PATENT DOCUMENTS

| | | | | |
|---|---|---|---|---|
| 2,100,258 | A | * 11/1937 | Larsen | 428/649 |
| 3,847,203 | A | * 11/1974 | Northwood | 164/96 |
| 4,708,847 | A | * 11/1987 | Donomoto et al. | 420/129 |
| 6,085,830 | A | * 7/2000 | Mashiko et al. | 165/80.3 |
| 6,360,809 | B1 | * 3/2002 | Cornie et al. | 164/65 |

* cited by examiner

*Primary Examiner*—Kevin P. Kerns
(74) *Attorney, Agent, or Firm*—Troxell Law Office, PLLC

(57) ABSTRACT

A sink compound laminate molding process having a copper material in thickness of 0.1–0.8 mm placed at the bottom of the molding cavity with the bottom of the copper laminate fully bound to the bottom of the molding cavity, the copper being heated up to 300–600° C., and molten aluminum being filled into the molding cavity using a gravity casing process to create diffusion bonding to the interface between the copper and aluminum materials, molten aluminum being cooled and cured to avail an integrated compound laminate in a given profile of heterogeneous copper and aluminum.

8 Claims, 3 Drawing Sheets

SINK COMPOUND LAMINATE MODELING PROCESS

BACKGROUND OF THE INVENTION (a) Field of the Invention

The present invention is related to a molding process for sink compound laminate, and more particularly, to one that achieves integrated heterogeneous alloy of copper and aluminum by diffusion bonding to the interface between both metal materials into a given profile for taking advantage of highly efficient heat conduction property of the copper section to conduct at the first time the heat from the heat source to the entire aluminum section that covers up the copper section to dissipate the heat by the profile of the aluminum section.

(b) Description of the Prior Art

Sinks in PCs or desktop computers generally available in the market are provided in types of extruded aluminum, CNC integrated aluminum cast and copper, and copper fin laminated to copper base sheet. Wherein, the aluminum alloy sink though featuring lightweight, has poor heat conduction efficiency and fails to at the first time conduct the heat from the heat source to the entire aluminum sink. Copper alloy gives better heat conduction property, but it is found defectives of being heavy and requires a comparatively complex process.

In an earlier improvement made by this author, a casting process involving heterogeneous metals was used for the manufacturing of copper and aluminum integrated sink base sheet to take advantage of the high heat conduction property of the copper sheet to rapidly conduct the heat from the heat source to the entire sink to dissipate the heat by the sink profile of the aluminum alloy provided on the top of the copper sheet for significantly upgrading the sink efficiency while providing at the same time the high efficiency of heat conduction by copper and the lightweight feature of the aluminum alloy.

However, in the casting process, the aluminum alloy is in a semi-fusion (atomized) status to be bound to copper. The binding force is comparatively weak between those two heterogeneous metals and the stripping strength is insufficient.

SUMMARY OF THE INVENTION

The primary purpose of the present invention is to provide a sink compound laminate molding process. Wherein, a gravity casting process is used to directly pour the molten aluminum into the surface of copper, which has been already heated up to 300–650° C. Activities of the copper and aluminum are high enough to easily produce chemical binding reaction as chemical compounds with a branch structure can be leached from copper to react with aluminum and the branch structure of the chemical compound covers up the periphery of the crystals of aluminum resulting in diffusion bonding to significantly improve the binding force between copper and aluminum.

Another purpose of the present invention is to provided a sink compound laminate molding process that an inert gas is injected into the molding cavity during the preheating process of the copper or the molding cavity is in a vacuumed status to prevent oxidization from the surface of copper.

DETAILED DESCRIPTION OF THE PREFERRED EMBODIMENTS

Figure 1:
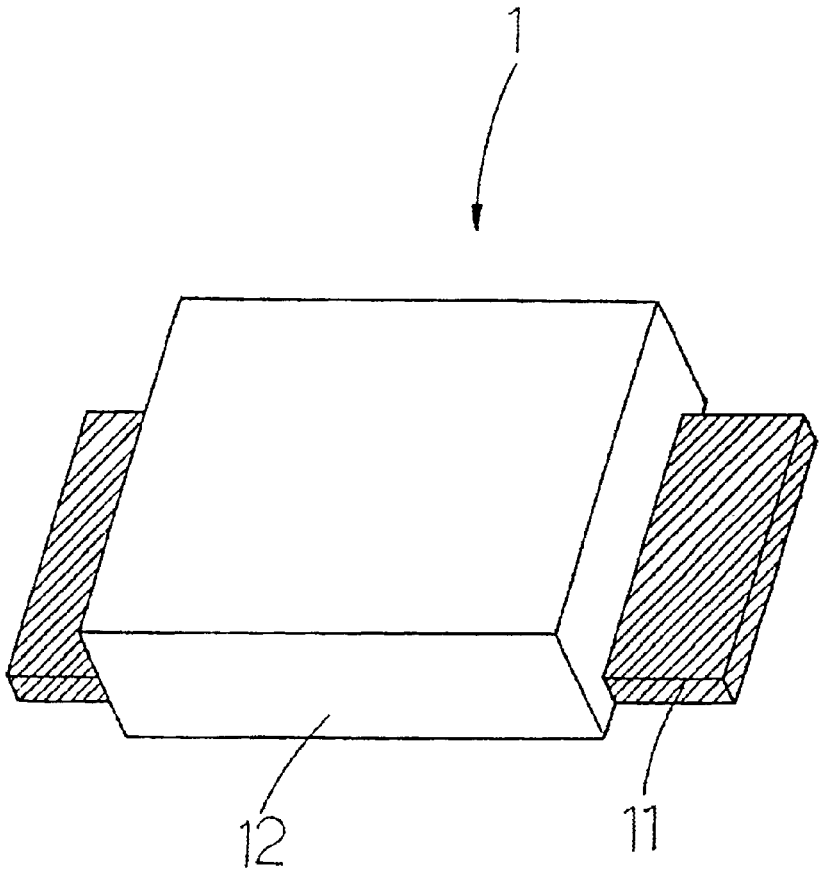
FIG. 1 is a schematic view showing the structure of the compound laminate of the present invention.

The present invention is related to a sink compound laminate molding process. Referring to FIG. 1, a compound laminate (1) is provided with a net profile defined by an aluminum material (12) with a copper material (11) bound to the bottom of the net profile of the aluminum material (12) so that when the sink molded from the compound laminate (1) contacts a heat source with the copper material (11), the high heat conduction property of the copper material (11) rapidly conducts the heat to the aluminum material (12) covering up the copper material (11) for the profile of the aluminum material (12) on top of the copper material (11) to dissipate the heat.

Figure 2:
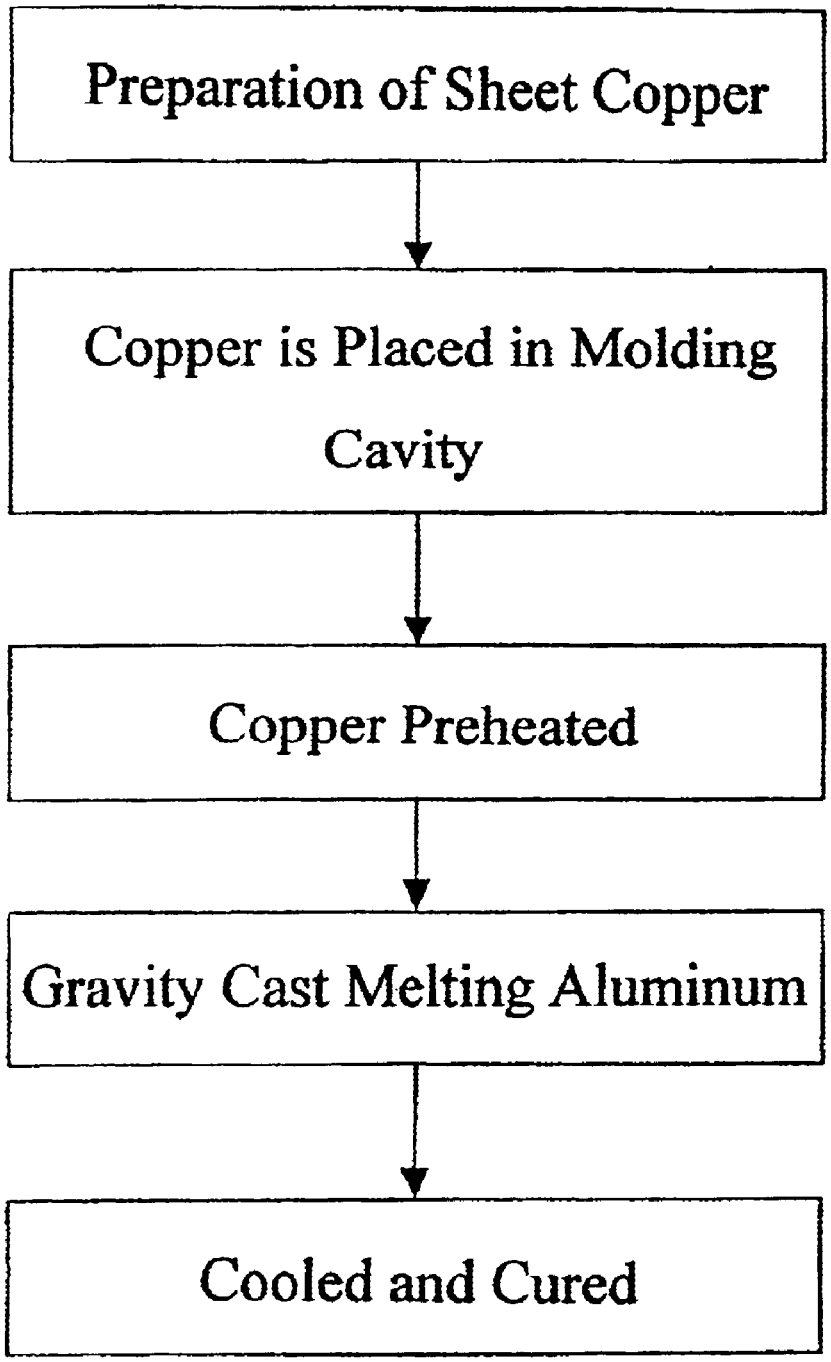
FIG. 2 is a process flow chart of the present invention.

Now referring to FIG. 2 for the molding process of the present invention, wherein, the process includes the following steps:

Step 1: Prepare sheet copper material in a thickness of 0.1–8.0 mm depending on the profile of the sink, the copper sheet material may have a various shape including a triangle or a strip;

Step 2: Place the copper material in the molding cavity to such extent that the bottom of the copper material completely bound to the bottom layer of the molding cavity;

Step 3: The copper material is heated up to 360–650° C. and an inert gas is injected into the molding cavity or the molding cavity is maintained in vacuumed status to prevent oxidization taking place on the surface of the copper material; and Step 4: The molten aluminum material is poured into the molding cavity using a gravity casting process to create a diffusion bonding to the interface between both of the copper and aluminum materials.

Figure 3:
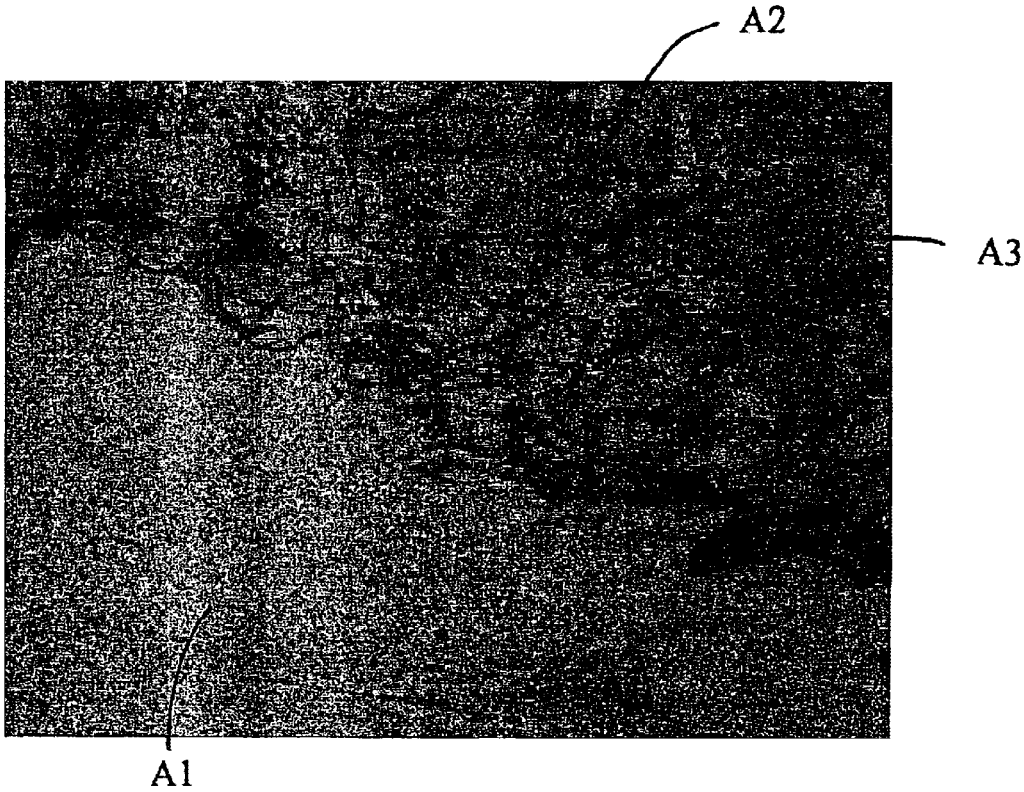
FIG. 3 is a blowup view of the interface between copper and aluminum bound by using the process of the present invention.
Figure 4:
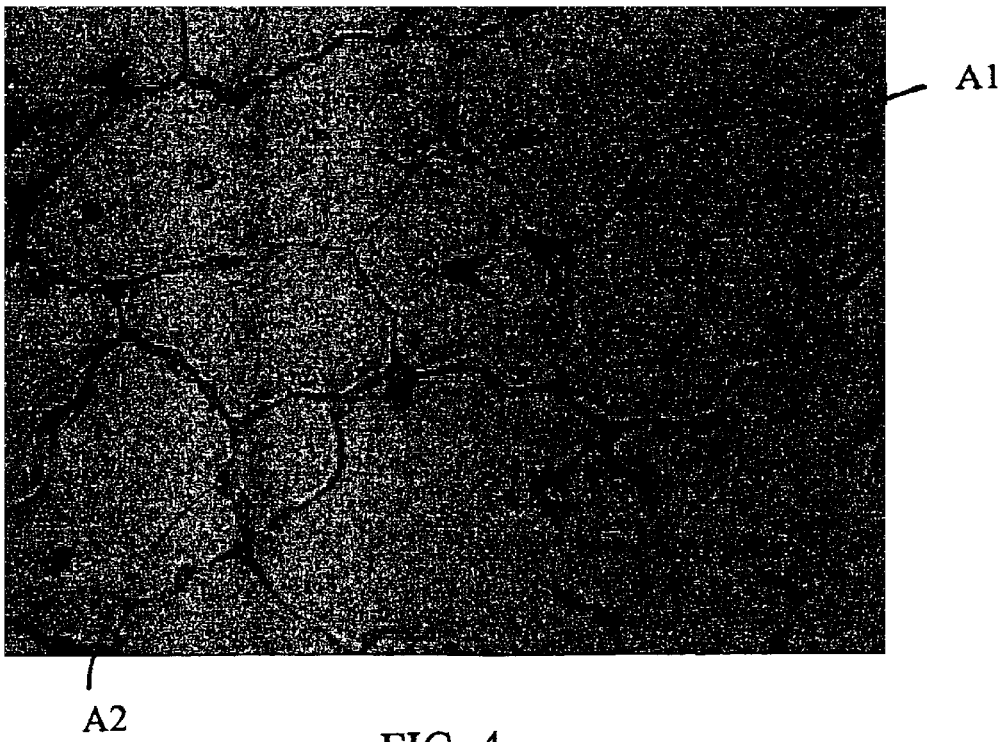
FIG. 4 is a blowup view of the aluminum crystals completed with the binding using the process of the present invention.

Finally, the aluminum material is cooled down and cured to avail a structure of a compound laminate of an integrated heterogeneous alloy of copper and aluminum in a given profile. Wherein, the distribution of crystals on the copper/aluminum interface as illustrated in FIG. 3, the segment marked with Area 1 (A1) relates to the area of copper materials, Area 2 (A2) relates to the aluminum area; and Area 3 (A3) relates to the leached copper product indicating that certain part of copper will be leached out in the interface between the copper and aluminum materials during the gravity casting process for the aluminum material to tightly bind to the aluminum material. As illustrated in FIG. 4, the segment marked with Area 1 (A1) relates to aluminum crystals; and Area 2 (A2) leached copper product indicating that the leached copper is permeable along the interface of the aluminum crystals and further surrounding around the aluminum crystals to form a chemical compound with a branch structure. Aluminum crystals are enclosed in the chemical compound in the branch structure to produce diffusion bonding, and thus the significantly improved binding force between the copper and the aluminum materials.

Strict copper or copper alloy, and strict aluminum or any aluminum alloy selected from a group comprised of AlSiCu, AlSiZn, AlSiMg, AlSiCuMg, AlGe, AlGeSi, AlCu, AlMn, AlMg, AlLi, AlSn, and AlPb respectively for the copper and aluminum materials in the present invention. Table 1 lists physical properties of copper and aluminum that may serve for the diffusion bonding. In general, the copper is heated to 500–1100° C. to be pre-oxidized into melting status to proceed binding with the molten aluminum. Before the operation, it should be confirmed that the oxygen differential pressure and the binding temperature are respectively at their critical points, and that the binding temperature is at the eutectic temperature instead of the melting point of copper at 1083° C.

The present invention adopts the gravity casting process to directly pour the molten aluminum material into the surface of the copper material preheated to 300–650° C. Both of the copper and the aluminum materials are at their high activities to generate chemical reaction for the copper materials to be leached out to react with the aluminum material and to produce a chemical compound in branch structure; in turn, aluminum crystals are enclosed by the chemical compound in branch structure to yield diffusion bonding, and thus to significantly improve the binding force between the copper and the aluminum materials. As a result, the finished product of the sink provides excellent heat dissipation performance while the process features low production cost and easy process to be comprehensively applied in the production of various types of sink. Therefore, this application is duly filed accordingly.

TABLE 1

| Material | Aluminum | Copper |
|---|---|---|
| Specific Weight | 2.7 | 8.9 |
| Melting Point (° C.) | 660 | 1083 |
| Boiling Point (° C.) | 1800 | 2310 |
| Linear Expansion Coefficient (1/° C.) | $23 \times 10^{-6}$ | $17 \times 10^{-6}$ |
| Specific Heat | 0.21 | 0.092 |
| Heat Conduction Rate | 0.49 | 0.92 |

What is claimed is:

1. A sink compound laminate molding process, which comprises the steps of:

a) preparing a sheet copper material having a thickness between 0.1 mm and 8.0 mm;

b) placing the copper sheet material in a molding cavity and positioning a bottom of the copper sheet material against a bottom of the molding cavity;

c) heating the copper sheet material to a temperature between 360° C. and 650° C. and performing one of injecting an inert gas into the molding cavity and maintaining a vacuum in the molding cavity to prevent oxidization from taking place on the surface of the copper material;

d) pouring a molten aluminum material over the sheet copper material in the molding cavity using a gravity casting process to create a diffusion bonding to an interface between both of the copper and aluminum materials; and e) cooling and curing the aluminum material forming a structure of a compound laminate of an integrated heterogeneous alloy of copper and aluminum, wherein crystals are present in the interface between the copper and the aluminum materials.

2. A sink compound laminate molding process as claimed in claim 1, wherein in the heating step c), the inert gas is introduced into the molding cavity in the course of heating the copper material to prevent oxidization from taking place on the surface of the copper material.

3. A sink compound laminate molding process as claimed in claim 1, wherein in the heating step c), the vacuum is maintained in the molding cavity during the course of heating the copper material to prevent oxidization from taking place on the surface of the copper material.

4. A sink compound laminate molding process as claimed in claim 1, wherein the copper sheet material is pure copper.

5. A sink compound laminate molding process as claimed in claim 1, wherein the copper sheet material is a copper alloy.

6. A sink compound laminate molding process as claimed in claim 1, wherein the sheet copper material is a shape selected from the group consisting of a triangle and a strip.

7. A sink compound laminate molding process as claimed in claim 1, wherein the aluminum material is pure aluminum.

8. A sink compound laminate molding process as claimed in claim 1, wherein the aluminum material is an aluminum alloy selected from the group consisting of AISiCu, AISiZn, AISiMg, AISiCuMg, AIGe, AIGeSi, AICu, AIMn, AIMg, AILi, AISn and AIPb.

* * * * *